US005344550A

United States Patent [19]

Kaneda et al.

[11] Patent Number: 5,344,550

[45] Date of Patent: Sep. 6, 1994

[54] PROCESS FOR PRODUCING SURFACE-TREATED STEEL SHEET SUPERIOR IN WELDABILITY AND PAINT-ADHESION

[75] Inventors: Yoshihiro Kaneda; Ryoichi Yoshihara; Ryousuke Wake, all of Himeji, Japan

[73] Assignee: Nippon Steel Corporation, Tokyo, Japan

[21] Appl. No.: 73,665

[22] Filed: Jun. 8, 1993

Related U.S. Application Data

[62] Division of Ser. No. 823,362, Jan. 21, 1992, Pat. No. 5,248,405.

[30] Foreign Application Priority Data

Jan. 24, 1991 [JP] Japan ..... 3-7036

[51] Int. Cl.[5] ..... B32B 15/01

[52] U.S. Cl. ..... 205/50; 205/154; 205/302; 428/648; 428/667; 428/687

[58] Field of Search ..... 205/50, 154, 156, 170, 205/178, 302, 303, 304; 428/648, 667, 687

[56] References Cited

U.S. PATENT DOCUMENTS 4,579,786 4/1986 Nakakouji et al. ..... 428/648

FOREIGN PATENT DOCUMENTS 282498 11/1990 Japan .

*Primary Examiner*—John Niebling
*Assistant Examiner*—Kishor Mayekar
*Attorney, Agent, or Firm*—Wenderoth, Lind & Ponack

[57] ABSTRACT

A surface-treated steel sheet is provided, at a low cost, which has high weldability and is useful for a material of containers of foods and beverages. The surface treatment is conducted by applying flattened granular tin coating deposits having a specified diameter and high adhesion on a steel sheet surface at a specified plated area ratio, and applying thereon a metallic chromium coating and a chromium hydrate oxide coating.

In the surface treatment, firstly, the surface of a steel sheet is subjected to tin-plating in an acidic tin plating bath containing a conventionally used brightener in an amount of from 0,001 to 0.05 g/l so as to form flattened granular tin coating deposits having a diameter of 0.4–2.4 μ at a plated area ratio of 5 to 30% and to improve the adhesion to the steel sheet and decrease falling-off of the granular tin coating deposits until completion of chrome-plating, thereby the variation of the amount of tin coating being decreased. Subsequently, the sheet is plated with metallic chromium in an amount of 50–150 mg/m$^2$, and further chromium hydrate oxide layer is formed in an amount of 2–40 mg/m$^2$ as chromium. Thus a surface-treated steel sheet, which has satisfactory surface appearance, paint adhesiveness, under-paint-coating corrosion resistance of conventional tin-free steel sheets, and stable weldability, is producible at a low cost.

3 Claims, 3 Drawing Sheets

1: Underlying Iron
2: Granular Tin Deposit
3: Metallic Chromium-Chromium Oxide Layer x 10.000 x 10.000 x 10.000

1: Underlying Iron
2: Granular Tin Deposit
3: Metallic Chromium-Chromium Oxide Layer

PROCESS FOR PRODUCING SURFACE-TREATED STEEL SHEET SUPERIOR IN WELDABILITY AND PAINT-ADHESION

This application is a division of application Ser. No. 823,362, filed Jan. 21, 1992 now U.S. Pat. No. 5,248,405.

BACKGROUND OF THE INVENTION

Field of the invention

The present invention relates to a process for producing a surface-treated steel sheet or strip (hereinafter called "sheet") for welded cans suitable for packing and storing foods, beverages, and the like.

Description of the Related Art

The materials for containers for foods, beverages and the like include generally tin-coated steel sheets and tin-free steel sheets. In recent years, thinly tin-coated steel sheets having a subdued amount of tin-coating (including those having nickel coating as an underlayer for assuring weldability), nickel coated steel sheets, and the like have also come to be used for the purpose of lowering the material cost. However, the tin-free steel sheet is much superior to the tin plate, and also to the thinly tin-coated steel sheets and the nickel-plated steel sheets, when compared simply in view of cost. The tin-free steel sheet is also excellent in paint adhesion and under-paint-coating corrosion resistance. Because of these excellent properties, the demand for tin-free steel sheets is rising. However, the tin-free steel sheet has a serious disadvantage of low weldability, and working of the tin-free steel sheet into cans has hitherto been conducted in most cases, by an adhesion method, or by a welding method in which a coating layer of metallic chromium and chromium oxide on the steel surface is removed by grinding before the welding. Therefore, the improvement of the weldability of the tin-free steel sheet is of great industrial significance, and various attempts have been made to improve the weldability of the tin-free steel sheet. For example, tin coating is applied as an underlayer prior to the chrome plating to improve the weldability as disclosed by Japanese Patent Publications Hei 2-16397 and Sho 61-1518, and Japanese Laid-Open Patent Applications Sho 56-127776 and Sho 56-44793. These attempts are all directed to the improvement of insulation properties of a chrome-coating and a chromium hydrate-oxide coating to provide improved weldability. In these improvements, however, a larger amount of tin-coating as the underlayer is required for decreasing contact resistance, which sacrifices the inherent desirable properties of a tin-free steel sheet in return for improvement of weldability similarly as in the case of thinly tinned steel sheets. Thus in all of the above attempts, the inherent desirable properties of tin-free steel sheets, such as metallic surface luster, high paint adhesion, and under-paint-coating corrosion resistance are lost even though the weldability of the tin-free sheet is improved. Therefore, the surface-treated steel sheets obtained by the above-described prior arts are not always satisfactory for the cans.

In order to solve the problems of the prior arts the inventors of the present invention developed a process for producing surface-treated steel sheet as disclosed in Japanese Laid-Open Patent Application Hei 2-282498 in which granular tin coating is applied on the steel sheet to impart weldability to the steel sheet without impairing the inherent desirable properties of tin-free steel sheets, namely metallic surface luster, high paint adhesion, and under-paint coating corrosion resistance.

The above disclosed process for producing a surface-treated steel sheet superior in weldability and paint adhesiveness comprises degreasing and acid-pickling a steel sheet; tin-plating the steel sheet in an acidic tin plating bath containing no conventional brightener under plating conditions: a bivalent tin concentration of 2–20 g/l, an acid concentration of 10–50 g/l (in terms of sulfuric acid), a plating current density of 2–15 A/dm$^2$, and plating amount of 20–200 mg/m$^2$ so as to give tin coating deposits in a granular shape having a diameter of 0.2–1.5 μm; and subsequently coating the tin-plated steel sheet with metallic chromium in an amount of 30–150 mg/m$^2$, and chromium oxide in an amount of 2–40 mg/m$^2$ in terms of chromium by a conventional chrome plating process, or a conventional chrome plating and chromate treatment process.

This process provides a surface-treated steel sheet having weldability without impairing inherent superior properties of the tin-free steel sheet.

However, the above process of granular tin coating as the underlayer does not give sufficient adhesion of the granular tin deposits, so that the granular tin deposits are liable to fall off, after plating, during passing through a water-washing and other steps prior to the chrome plating due to slippage between a steel strip and rolls, or other causes during a continuous plating process of the steel strip. Accordingly, even if the amount of tin coating is controlled successfully in the tin-plating step, the amount of the granular tin coating will vary in the chrome plating step, which causes large variation of imparted weldability, and renders the quality control difficult.

SUMMARY OF THE INVENTION

The present invention intends to decrease the falling-off of the deposited granular tin coating before chrome plating by improving the adhesion of the tin coating without impairing the inherent superior properties of tin-free steel sheets, thereby decreasing the variation of the amount of underlayer granular tin coating and assuring stable weldability.

The present invention provides a process for producing a surface-treated steel sheet superior in weldability and paint adhesion, comprising steps of degreasing and acid-pickling a steel sheet surface; tin-plating the steel sheet surface in an acidic tin-plating bath containing a conventional brightener in an amount of from 0,001 to 0.05 g/l so as to form granular tin deposits having a diameter of 0.4–2.4 μm at a plated area ratio of 5–30%; and subsequently coating the tin-plated steel sheet with metallic chromium in an amount of 50–150 mg/m$^2$ and chromium oxide in an amount of 2–40 mg/m$^2$ in terms of chromium by a conventional chrome plating process, or a conventional chrome plating and chromate treatment process.

In the above process, the steel sheet is applied with granular tin coating deposits having a grain diameter of from 0.4 to 2.4 μm at a plated area ratio of from 5 to 30% in the acidic tin-plating bath under the tin plating conditions of a bivalent tin ion concentration M (g/l), a plating current density D (A/dm$_2$), and a tin coating amount W (mg/m$^2$) satisfying the formulas (1) and (2):

$$0.4 \leqq 0.582\,(0.05M - 0.06D + 0.325)\log W \leqq 2.4 \qquad (1)$$

-continued $$5 \leqq \frac{0.2835W}{(0.05M - 0.06D + 0.325)\log W} \leqq 30 \quad (2)$$

$$20 \leqq W \leqq 300$$
$$4 \leqq M \leqq 30$$
$$2 \leqq D \leqq 24$$

DETAILED OF THE PREFERRED EMBODIMENT

Figure 1A:
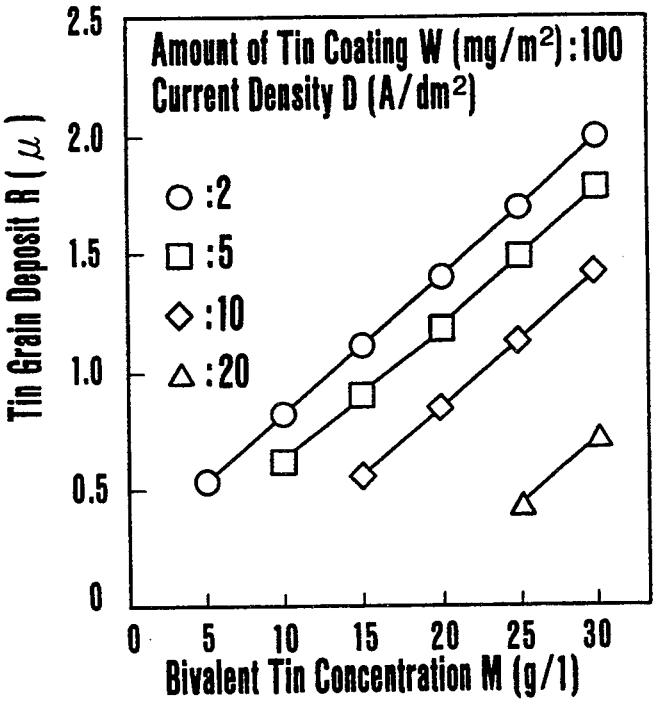
FIG. 1A shows the dependency of the diameter of the flattened granular tin coating deposits on the bivalent tin ion concentration with the current density as a parameter.

The present invention is based on the discovery of a method of controlling the deposition state of tin coating deposits to improve adhesion of the tin coating. Thus the shape of granular tin coating deposits is slightly flattened by adding an extremely small amount of a brightener into an acidic tin-plating bath. Without the brightener in the tin-plating bath (e.g. the bath described in Japanese Laid-Open Patent Application Hei 2-282498, the tin crystal grows in a direction perpendicular to the steel sheet surface, with a height of the granular tin coating deposits equal to or larger than the diameter of the same. The granular coating in such a state is liable to fall off on contact with rolls or the like. In contrast thereto, an extremely small amount of a brightener added into the bath retards the tin deposit growth in the direction perpendicular to the steel sheet surface, but allows the tin deposit growth along the surface plane direction to give a granular tin coating in a shape of flattened deposits. In such a manner, the adhesion of the granular tin coating deposits is remarkably improved by enlargement of the area of contact of the granular tin coating deposits with the steel sheet relative to the height of the granular tin coating deposits. After the application of the flattened granular tin coating deposits as above, chrome plating, or chrome plating and chromate treatment is conducted, thereby a surface-treated steel sheet having stable weldability is obtained. If the bath contains a larger amount of a brightener (for example, at an additive concentration of 0.2 to 2 g/l as shown in Japanese Patent Publication Hei 2-16397), tin will deposit exclusively in a plane shape, which increases the amount of the tin coating required to provide the weldability, with consequence of the inherent desirable properties of tin-free steel sheets being lost.

The kind of the additive to be added as the brightener to the tin-plating bath is not specially limited. The examples of the suitable brighteners include ethoxylated α-naphthol, ethoxylated α-naphtholsulfonic acid, and the like which are conventionally used in tin plating process. The concentration of the additive in a tin-plating bath is limited to be in the range of from 0.001 to 0.05 g/l. The reason therefor is as follows. At a concentration lower than the lower limit of the range, the granular tin coating deposits will not become flattened and the adhesion of granular tin coating deposits will not be improved. On the contrary, at a concentration higher than the upper limit of the range, despite improved adhesion of the tin coating, the tin coating is in a plate shape (or in a finely rugged state), and is by no means in a flattened deposit shape with the surface ruggedness insufficient for desired improvement of weldability, although the tin coating deposits occur locally with the steel surface being left locally uncoated, resulting in no improvement of weldability.

The conditions for obtaining flattened granular tin coating deposits are described below.

Figure 1B:
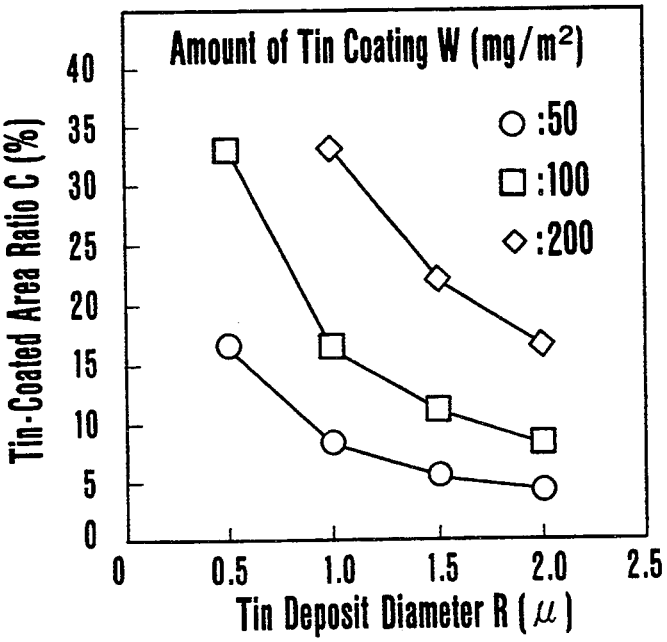
FIG. 1B shows the dependency of the diameter of the flattened granular tin coating deposits on the tin-plated area ratio with the amount of tin coating as a parameter.

FIG. 1A shows an example of measurements of the diameter (μm) of the deposited flattened granular tin coating deposits as a function of the tin-plating conditions: the bivalent tin ion concentration M (g/l), the tin plating current density D (A/dm$^2$), and the amount of plated tin W (mg/m$^2$). FIG. 1B shows an example of the results of measurement of relations of the granular coating deposit diameter R, the amount of tin coating W, and the tin-plated area ratio C (%). By analyzing these results, the equation (3) below is derived regarding the diameter of the flattened granular tin coating deposits, and the equation (4) is derived regarding the tin-plated area ratio.

$$R = 0.582(0.05M - 0.06D + 0,325)\log W \quad (3)$$

$$C = 0,165W/R \quad (4)$$

The tin plating for flattened granular tin coating deposits of from 0.4 to 2.4 μm in diameter on a steel sheet at a tin-plated area ratio of from 5 to 30% is achievable under the conditions of the bivalent tin ion concentration M (g/l) in the acidic tin-plating bath, the tin-plating current density D (A/dm$^2$), and the amount of tin coating W (mg/m$^2$).

$$0.4 \leqq 0.582\,(0.05M - 0.06D + 0.325)\log W \leqq 2.4 \quad (1)$$

$$5 \leqq \frac{0.2835W}{(0.05M - 0.06D + 0.325)\log W} \leqq 30 \quad (2)$$

$$20 \leqq W \leqq 300$$
$$4 \leqq M \leqq 30$$
$$2 \leqq D \leqq 24$$

The present invention is distinguished from the invention disclosed in Japanese Laid-Open Patent Application Hei 2-282498 as described below. The diameter of the granular tin coating deposits is in the range of from 0.4 μm to 2.4 μm in the present invention. The upper limit of the deposit diameter is raised to 2.4 μm from 1.5 μm of the prior art. In the cited prior art, a larger diameter of the granular tin coating deposits results in a larger height of the granular tin coating deposits in a brightener-free plating bath, with a great tendency of falling off of the granular coating deposits from the substrate steel sheet and to contact with rolls etc.. Therefore, in the prior art the deposit diameter had to be not larger than 1.5 μm. In the present invention, however, the granular tin coating deposits are flattened by addition of an extremely small amount of a brightener, which makes satisfactory the adhesion of granular tin coating deposits in the diameter range of up to 2.4 μm. The broadening of the deposit diameter range up to 2.4 μm broadens the ranges of the tin plating condition including the tin concentration in the tin plating bath, the tin plating current density, and the amount of tin coating. Further, the lower limit of the deposit diameter is raised from 0.2 μm in the prior art to 0.4 μm in the present invention. This is because the granular tin coating deposits are flattened to enlarge the contact area thereof with the steel sheet. The acid concentration is not limited specially, and may be at a level which allows the bivalent tin ion to exist stably. The concentration is preferably in the range of from 10 to 100 g/l (in terms of sulfuric acid) depending on the bivalent tin ion concentration.

Figure 2A:
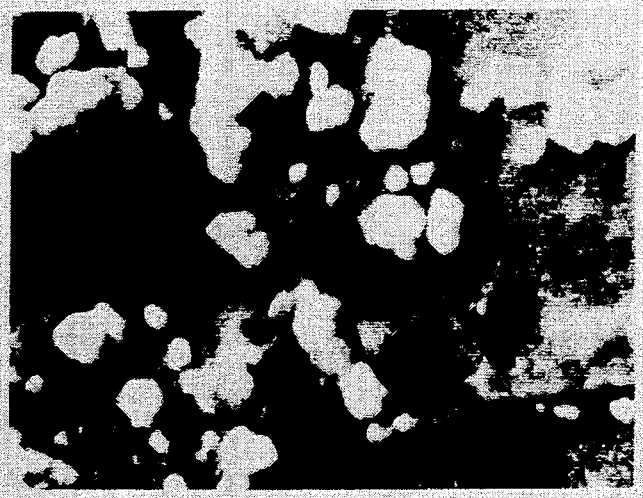
FIGS. 2A, 2B, and 2C are photographs of external metal structures taken by scanning electron microscopy after the tin plating in the tin-plating bath containing a brightener at various concentrations of 0,025 g/l (FIG. 2A), 0 g/l (FIG. 2B), and 1 g/l (FIG. 2C).
Figure 2B:
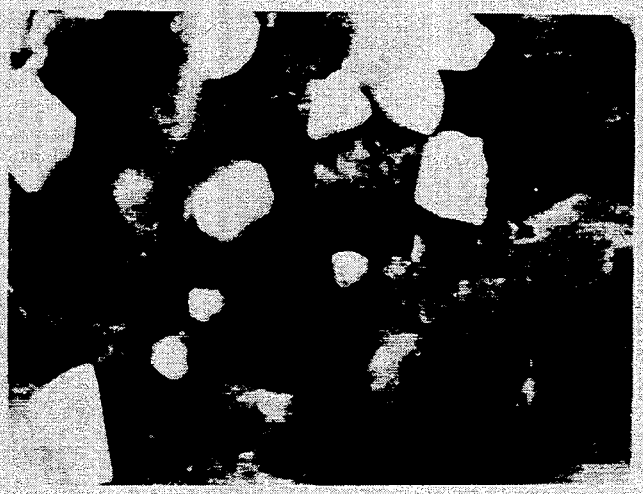
Figure 2C:
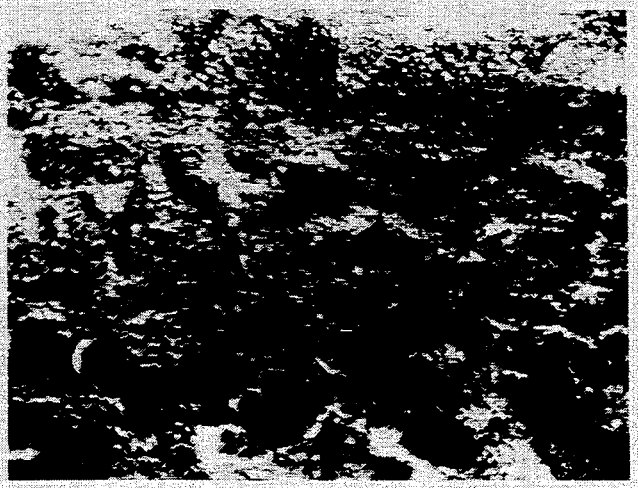

FIGS. 2A, 2B, and 2C are photographs (×10,000) taken by scanning electron microscopy of the flattened granular tin coating deposits obtained by using a tin-plating bath containing an extremely small amount of a brightener according to the present invention (FIG. 2A); of the tin coating deposits obtained by using a tin plating-bath containing no brightener (FIG. 2B); and the tin coating deposits obtained by using a tin-plating bath containing a large amount of a brightener (FIG. 2C). The tin plating process was conducted by use of a phenolsulfonic acid bath at brightener concentrations of (a): 0.025 g/l, (b): 0 g/l, and (c): 1 g/l, and at the bivalent tin ion concentration of 10 g/l, the acid concentration of 50 g/l (in terms of sulfuric acid), the current density of 3A/dm$^2$, and the tin coating amount of 100 mg/m$^2$.

Figure 3A:
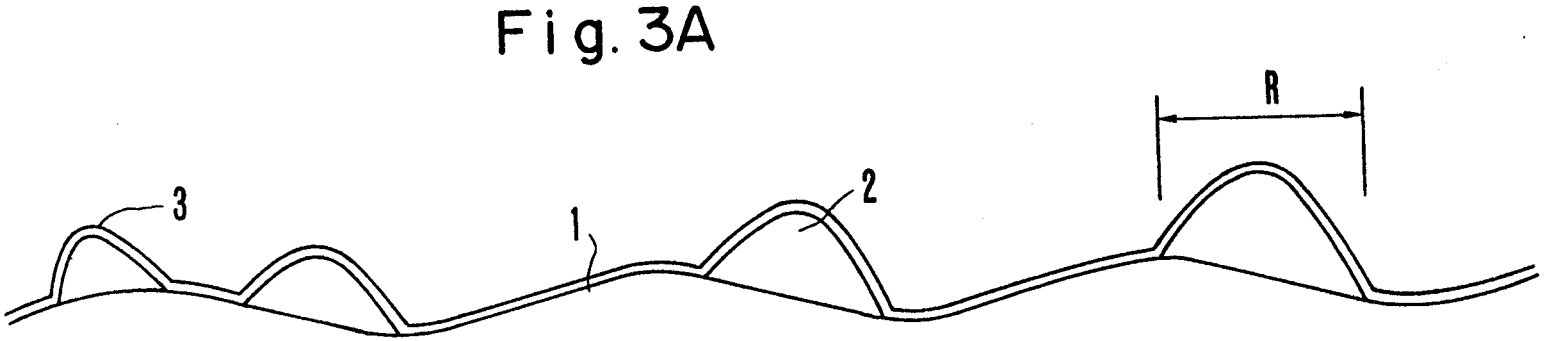
FIG. 3A and FIG. 3B are schematic sectional views of the surface films of a surface-treated steel sheet produced by the process of the present invention (FIG. 3A), and by using a bath containing no brightener (FIG. 3B).
Figure 3B:
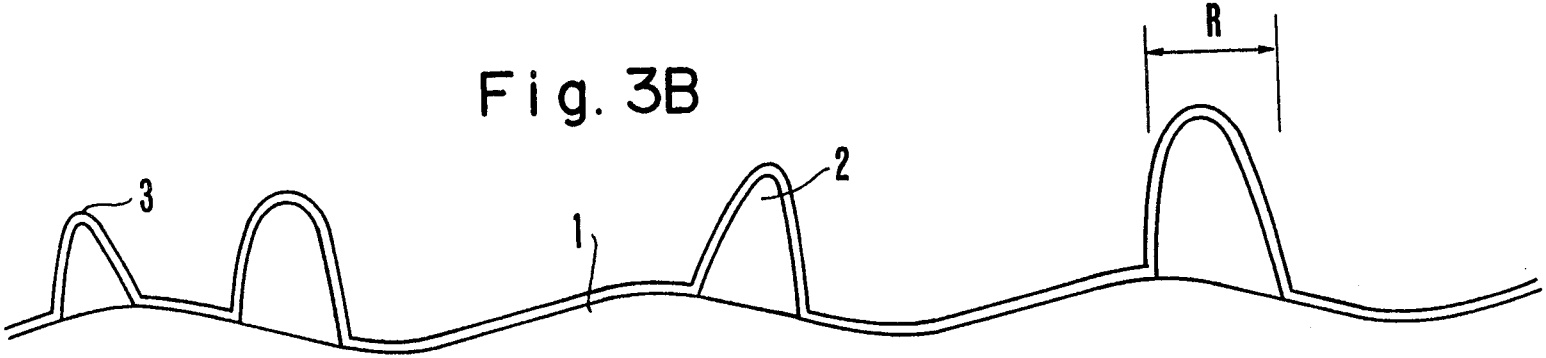

FIG. 3A is a sectional view of the flattened granular tin coating deposits obtained by use of a tin-plating bath containing an extremely small amount of a brightener according to the present invention. FIG. 3B is a schematic sectional view of granular tin coating deposits obtained by use of a tin-plating bath containing no brightener. In the drawings, the numeral 1 denotes a substrate steel sheet, 2 granular tin coating, and 3 a metallic chromium-chromium oxide layer.

The chrome plating and the chromate treatment will be explained below. In the present invention, the methods of chromium plating and the chromate treatment are not specially limited, and may be conducted according to any conventional method of producing tin-free steel sheets. The ratio of the area occupied by granular tin coating deposits is not more than 30%. Accordingly, the conventional chrome plating and chromate treatment allows the formation of a layer of metallic chromium and chromium oxide on the uncoated surface of the steel sheet, and gives the properties same as those of usual tin-free steel sheets. Under certain plating conditions, chromium does not deposit on the already existing granular tin coating deposits but only a chromium oxide layer is formed thereon, and vice versa. However, within the range of the investigation made by the present inventors, the deposition of chromium on the granular tin coating deposits is slightly less than the deposition thereof on the uncoated portion of the steel sheet. Even when chromium deposits on the granular tin coating deposits, the layer composed of 150 mg/m$^2$ of metallic chromium and 40 mg/m$^2$ of chromium oxide (in terms of metallic chromium) has a thickness of about 0.04 μm, and the underlying tin coating has a thickness larger than that, which is considered to serve to reduce the contact resistance. Accordingly in the present invention, the state of chromium deposition on the tin coating is not specially limited, but it is important that chromium coating layer and a chromium oxide layer are formed directly on the uncoated portion of the steel plate. For this reason, the amount of the chrome coating layer and the chromium oxide layer is limited respectively to be in the range of metallic chromium of from 50 to 150 mg/m$^2$ and in the range of chromium in the chromium oxide layer of from 2 to 40 mg/m$^2$ (in terms of metallic chromium), which are usual for tin free steel sheets. Generally, the metallic chromium exhibits sufficient under-paint-coating corrosion resistance at a coating amount of 30 mg/m$^2$ or more. In the present invention, however, the lower limit of the amount of the metallic chromium is slightly raised in order to suppress the influence of the flattened granular tin coating deposits of the underlayer and to assure the under-paint-coating corrosion resistance. Further, while the chromium in the chromium oxide layer is required generally to be in an amount of not less than 10 mg/m$^2$ to secure sufficient adhesion strength in can making by adhesion, the amount of the chromium is slightly lowered in the present invention. This is because the amount of chromium of about 2 mg/m$^2$ is sufficient to secure generally the under-paint-coating corrosion resistance, and also because the chromium oxide layer which adversely affects seam-weldability is desired to have a smaller thickness.

The present invention will be described in more details by reference to examples and comparative examples below.

EXAMPLES

A continuous plating apparatus was employed which has steps of degreasing, acid-pickling, tin-plating, and chrome-plating, and water-washing step after each of the above steps. The steel sheet used was low-carbon cold-rolled steel sheet having a thickness of 0.23 mm produced by a conventional process comprising cold rolling, continuous annealing, and temper rolling. The steel sheet was subjected to a usual degreasing treatment (cathode electrolysis treatment for 0.5 second under the conditions of NaOH: 50 g/l, temperature: 60° C., and current density: 10 A/dm$^2$), and a usual acid pickling treatment (cathode electrolysis treatment under the conditions of $H_2SO_4$: 50 g/l, temperature: room temperature, and current density: 10 A/dm$^2$). Thereafter the steel sheet was tin-plated and chrome-plated under the treatment conditions as shown below to obtain the sample sheets of Examples 1 to 10 and Comparative Examples 1 to 7 shown in Table 1. The sample sheets were tested for the items below. The results are shown in Table 1.

| | |
|---|---|
| 1. Tin plating conditions: | |
| (1) Bath conditions | |
| $Sn^{+2}$ | 2–30 g/l |
| Free acid concentration (as sulfuric acid) | 10–100 g/l |
| (Phenolsulfonic acid being used as the acid) | |
| Ethoxy-α-naphthol | 0–1 g/l |
| Bath temperature | 40° C. |
| (2) Electrolysis condition: | |
| Current density | 1–30 A/dm$^2$ |
| 2. Chrome plating conditions: | |
| (1) Bath conditions | |
| $CrO_3$ | 100 g/l |
| $H_2SO_4$ | 1.2 g/l |
| Bath temperature | 50° C. |
| (2) Electrolysis conditions: | |
| Current density | 50 A/dm$^2$ |

-continued

| | |
|---|---|
| Quantity of electricity | 50 C/dm$^2$ |

As the result of the chrome plating under the above plating conditions, the amount of the deposited chromium was in the range of from 90 to 110 mg/m$^2$ in which the amount of chromium oxide was in the range of from 8 to 10 mg/m$^2$.

3. Evaluation:

(1) Paint adhesion:

Onto a test specimen, an epoxyphenol paint (SJ-6256, made by Kansai Paint Co., Ltd.) was applied and baked (coating amount: 50 mg/dm$^2$). Then, the test specimen was subjected to retorting in 3.0% sodium chloride solution at 110° C. for 60 minutes. Subsequently, the paint coating film was cut with a knife in a checkerboard pattern, and tested for tape peeling resistance. The evaluation was made on the basis of 10 points (10 for good adhesion, and 1 for poor adhesion).

(2) Under-paint-coating corrosion resistance:

Onto a test specimen, an epoxyphenol paint (SJ-256, made by Kansai Paint Co., Ltd.) was applied and baked (coating amount: 50 mg/dm$^2$). Then the paint-coating film was cut with a knife in a cross pattern. The test specimen was immersed in a solution containing 1.5% sodium chloride and 1.5% citric acid at 50° C. for four days. Thereafter, the cross-cut portion was tested for tape peeling resistance. The evaluation was made on the basis of 5 points (5 for good resistance and 1 for poor resistance).

(3) Contact resistance:

The test specimen was heat-treated at 210° C. for 30 minutes. The test specimen was cut into 10 pieces of 50 mm square. Two pieces of the specimen were superposed and held between electrodes of 4.5 mm in diameter. The contact resistance was measured by flowing electric current of 1000 mA under pressure of 50 kgf applied between the electrodes. From the five measurement data, the mean value and the variation ($\sigma$) were obtained. The contact resistance of 500 $\mu\Omega$ is acceptable (good weldability).

(4) Evaluation of tin coating grain:

The tin-plated sample was observed with a scanning electron microscope at magnifications of from 5,000 to 10,000, and the diameter of the typical granular tin coating deposits and the tin-plated area ratio was measured.

(5) Amount of tin deposition:

The theoretical amount of tin deposition was shown.

(6) Adhesion of granular tin coating deposits:

The adhesion of granular tin coating deposits was evaluated by the ratio (%) of the amount of the deposited tin after the chrome plating relative to the theoretical amount of tin deposition on the test specimen. The ratio of 100% shows no falling-off of the granular tin coating deposits until the completion of the chrome-plating.

(7) Surface appearance of product:

The surface appearance was evaluated in comparison with a tin-free steel sheet. The symbol "○" shows approximately equal surface appearance to the tin-free steel sheet, and the symbol "X" shows different appearance from the tin-free steel sheet.

TABLE 1

| | | Tin-Plating Conditions | | | | | | | | | | | | |
|---|---|---|---|---|---|---|---|---|---|---|---|---|---|---|
| | No. | $Sn^{2+}$ g/l | Acid Concentration g/l | Current Density A/dm$^2$ | Additive Concentration g/l | Tin-Plated Area Ratio % | Granular Tin Coating Deposits Diameter $\mu$m | Deposited Tin mg/m$^2$ | Tin Coating Adhesion % | Product Appearance | Paint Adhesion | Under-Paint-Coating Corrosion Resistance | Contact Resistance $\mu\Omega$ Mean | Contact Resistance $\mu\Omega$ Variation $\sigma$ |
| Example | 1 | 30 | 100 | 5 | 0.02 | 18.3 | 2.1 | 290 | 80 | ○ | 10 | 5 | 109 | 4.9 |
| | 2 | 30 | 100 | 10 | 0.02 | 18.1 | 1.6 | 210 | 84 | ○ | 10 | 5 | 117 | 5.2 |
| | 3 | 30 | 100 | 20 | 0.02 | 28.7 | 0.8 | 150 | 90 | ○ | 10 | 5 | 158 | 6.9 |
| | 4 | 20 | 70 | 5 | 0.01 | 19.0 | 1.3 | 170 | 88 | ○ | 10 | 5 | 130 | 6.0 |
| | 5 | 20 | 70 | 5 | 0.02 | 19.2 | 1.3 | 170 | 89 | ○ | 10 | 5 | 126 | 5.7 |
| | 6 | 20 | 70 | 5 | 0.03 | 19.4 | 1.3 | 170 | 90 | ○ | 10 | 5 | 123 | 5.6 |
| | 7 | 20 | 70 | 10 | 0.02 | 24.9 | 0.9 | 150 | 91 | ○ | 10 | 5 | 144 | 6.8 |
| | 8 | 15 | 50 | 5 | 0.02 | 27.2 | 1.0 | 180 | 91 | ○ | 10 | 5 | 135 | 7.1 |
| | 9 | 10 | 35 | 3 | 0.02 | 23.6 | 0.7 | 120 | 83 | ○ | 10 | 5 | 163 | 8.3 |
| | 10 | 5 | 20 | 3 | 0.02 | 22.7 | 0.4 | 60 | 92 | ○ | 10 | 5 | 364 | 9.2 |
| Comparative Example | 1 | (2) | 10 | 2 | 0.02 | (73.9) | 0.4 | 190 | 94 | X | 10 | 4 | 784 | 10.3 |
| | 2 | 30 | 100 | (30) | 0.02 | (96.3) | (≦0.1) | 120 | 97 | X | 10 | 3 | 1430 | 43.9 |
| | 3 | 10 | 35 | (1) | 0.02 | (34.2) | 1.1 | 250 | 91 | X | 10 | 4 | 131 | 5.2 |
| | 4 | 30 | 100 | 10 | (0) | (4.3) | 1.6 | 210 | 40 | ○ | 10 | 5 | 146 | 35.1 |
| | 5 | 10 | 35 | 3 | (0) | 16.3 | 1.0 | 230 | 43 | ○ | 10 | 5 | 218 | 33.4 |
| | 6 | 30 | 100 | 5 | (0.1) | (98.5) | 0.1 | 290 | 95 | X | 10 | 3 | 1350 | 43.6 |
| | 7 | 10 | 35 | 3 | (1.0) | (95.8) | (≦0.1) | 120 | 96 | X | 10 | 3 | 1450 | 44.3 |

Note: Data with parentheses are outside the scope of the present invention.

From Table 1, the following will be clearly understood. In Comparative Examples 3 and 4 in which no additive is contained, the adhesion of granular tin coating deposits is poor, and variation of the contact resistance is large. In Comparative Examples 5 and 6 in which the additive is contained in an amount of more than 0.05 g/l, the tin coating is plate-shaped, the diameter of the granular tin coating deposits is as small as 0.1 $\mu$, and both the mean value and the variation of the contact resistance are large. On the contrary, in Examples 1 to 10 in which the additive is contained in an amount of from 0,001 to 0.05 g/l, the variation of the contact resistance is extremely small, thereby stable weldability being obtained.

Further, from Table 1, it is clear that, in Comparative Examples 1 to 3 in which the concentration of bivalent tin ion and the tin-plating current density are outside of the scope of the claim of the present invention, the surface appearance of the product and the under-paint-coating corrosion resistance are different from those of the tin-free steel plate, while in Examples 1 to 10 which are within the scope of the present invention, the inherent excellent properties of tin-free steel sheets are not impaired according to the evaluation of surface appearance of the product, the paint adhesion, and under-paint-coating corrosion resistance.

As described above, the present invention provides a surface-treated steel sheet having stable weldability by improving adhesion of granular tin coating to decrease falling-off of granular tin coating deposits until the completion of chrome-plating and to decrease the variation of the amount of the underlying granular tin coating, without impairing inherent excellent properties of tin-free steel sheets.

What is claimed is:

1. A steel sheet having deposited a the surface thereof a flattened granular tin coating having a diameter in a range of from 0.4 to 2.4 μm at a plated area ratio a the range of from 5 to 30%, said steel sheet being produced by a process which comprises degreasing and acid-pickling a steel sheet surface and tin-plating the steel sheet surface in an acidic tin-plating bath containing a conventional brightener in an amount of from 0.001 to 0.05 g/l.

2. A surface-treated steel sheet superior in weldability and paint adhesion produced in accordance with a process comprising the steps of degreasing and acid-pickling a steel sheet surface; tin-plating the steel sheet surface in an acidic tin-plating bath containing a conventional brightener in an amount of from 0,001 to 0.05 g/l so as to deposit flattened granular tin coating having a diameter in a range of from 0.4 to 2.4 μm at a plated area ratio in the range of from 5 to 30%; and subsequently coating the tin-plated steel sheet with metallic chromium in an amount of from 50 to 150 mg/m$^2$and chromium oxide in an amount of from 2 to 40 mg/m$^2$ in terms of chromium by a conventional chrome plating process, or a conventional chrome plating and chromate treatment process.

3. A surface-treated steel sheet according to claim 2, wherein the tin-plating in the acidic tin-plating bath is performed under the conditions of a bivalent tin ion concentration M (g/l), a plating current density D (A/dm$^2$), and a tin-coating amount W (mg/m$^2$), satisfying the formulas (1) and (2) below:

$$0.4 \leqq 0.582\,(0.05M - 0.06D + 0.325)\log W \leqq 2.4 \qquad (1)$$

$$5 \leqq \frac{0.2835W}{(0.05M - 0.06D + 0.325)\log W} \leqq 30 \qquad (2)$$

$$20 \leqq W \leqq 300$$
$$4 \leqq M \leqq 30$$
$$2 \leqq D \leqq 24.$$

* * * * *